US008134093B2

(12) United States Patent
Loew et al.

(10) Patent No.: US 8,134,093 B2
(45) Date of Patent: Mar. 13, 2012

(54) SWITCH ARRANGEMENT WHICH PERMITS OVERTHROW ACTUATION AND WIPING ACTION

(75) Inventors: Birger Loew, Wendlingen (DE); Werner Gräter, Berglen (DE)

(73) Assignee: Andreas Stihl AG & Co. KG, Waiblingen (DE)

( * ) Notice: Subject to any disclaimer, the term of this patent is extended or adjusted under 35 U.S.C. 154(b) by 235 days.

(21) Appl. No.: 12/656,475

(22) Filed: Feb. 1, 2010

(65) Prior Publication Data

US 2010/0193338 A1 Aug. 5, 2010

(30) Foreign Application Priority Data

Feb. 2, 2009 (DE) ..... 10 2009 007 030

(51) Int. Cl.
*H01H 3/04* (2006.01)

(52) U.S. Cl. ..... 200/335

(58) Field of Classification Search ..... 200/335, 200/332, 553; 173/170
See application file for complete search history.

(56) References Cited

FOREIGN PATENT DOCUMENTS

DE 227 281 9/1985

*Primary Examiner* — Edwin A. Leon
*Assistant Examiner* — Vanessa Girardi
(74) *Attorney, Agent, or Firm* — Walter Ottesen

(57) ABSTRACT

A switch arrangement includes a switch component (20) and a bearing component (21). The switch component (20) is pivotally journalled with a pivot bearing (36) on the bearing component (21). The switch arrangement includes a switch (14) which has a contact spring (19). In an unactuated, closed position (47), the contact spring (19) lies against a contact (18) of the switch (14). A simple configuration of the switch arrangement and a self cleaning effect can be achieved when the pivot bearing (36) has a torsion section (35) which permits an overpushing of the switch (14) beyond the unactuated, closed position (47) into an actuated, closed position (37). The contact spring (19) then slides on the contact (18) between the unactuated closed position (47) and the actuated closed position (37) and cleans the contact thereby.

19 Claims, 3 Drawing Sheets

SWITCH ARRANGEMENT WHICH PERMITS OVERTHROW ACTUATION AND WIPING ACTION

CROSS REFERENCE TO RELATED APPLICATION

This application claims priority of German patent application no. 10 2009 007 030.3, filed Feb. 2, 2009, the entire content of which is incorporated herein by reference.

BACKGROUND OF THE INVENTION

Switch arrangements having a bearing component on which a switch component is pivotally journalled are known. Switches of this kind are utilized, for example, as ignition switches in portable handheld work apparatus such as motor-driven chain saws, cutoff machines or the like. When the switch is closed, the contact spring lies against the contact.

In electrical switches, deposits can occur on the contacts which hinder a reliable closing of the switch.

German patent publication DD 227 281 A1 discloses a self-cleaning effect for a switch in that the spring element slides off the counter contact and possible deposits are rubbed off by the friction between the two parts. For this purpose, a contact spring having a special configuration is provided which slides off a plastic part having a defined contour. The plastic part on which the contact spring slides off applies a reset force thereto which effects the relative movement between the contact spring and the contacts.

SUMMARY OF THE INVENTION

It is an object of the invention to provide a switch arrangement of the kind described which has a simple configuration and operates functionally reliably.

The switch arrangement of the invention includes: a switch component; a bearing component; a switch including a contact and a contact spring lying in contact engagement with the contact in an unactuated closed position of the switch; a pivot bearing for pivotally journalling the switch component on the bearing component to permit a movement of the switch from an open position to the unactuated closed position and to an actuated closed position; the pivot bearing including a torsion section which permits an overpushing of the switch beyond the unactuated closed position into the actuated closed position; and, the contact spring sliding on the contact between the unactuated closed position and the actuated closed position.

A relative movement between the contact spring and the contact is achieved by a torsion section of the pivot bearing. The torsion section is a section of the pivot bearing which has an inherent elasticity. The torsion section is elastically deformed when actuating and overpushing the switch. When releasing the switch, the torsion section effects a reset because of its inherent elasticity and thereby a relative movement between contact spring and contact. The contact spring and the contact are so arranged that the contact spring slides on the contact during the reset movement. The unactuated closed position of the switch is a position wherein the switch is not actuated by the operator while the actuated closed position is a position wherein the operator actuates the switch and thereby deforms the torsion section. The overpushing of the switch by the operator advantageously takes place automatically in that the operator must apply an actuating force for actuating the switch which is so large that an overpushing automatically takes place with the movement of the switch.

The torsion section ensures that the switch always is in exactly the same position in the unactuated closed position. A defined switch position can be achieved in this way in a simple manner. The relative movement between the contact spring and the contact is effected by the torsion section which is part of the pivot bearing. For this reason, no additional components or special contours on the contact spring and/or the contact are needed. This results in a simple configuration. The pivot bearing which is present is used for the generation of the reset force.

To define the unactuated closed position, the bearing component and the switch component form a first stop for the pivot movement of the switch component at a distance to the contact spring measured in the direction of the pivot axis of the pivot bearing whereat the bearing component and the switch component lie one against the other in the unactuated closed position of the switch. The torsion section is advantageously arranged in an effective work direction between the first stop and the contact spring. The section of the pivot bearing, which lies in the effective work direction between the first stop and the contact spring, is elastically deformed with the overpushing of the switch and effects the reset movement of the switch component into the unactuated closed position. The force, which is needed for the overpushing, can be adjusted via the geometry of the torsion section.

To define the actuated closed position and prevent an impermissible deformation of the torsion section, it is advantageous to provide a second stop which prevents a movement of the switch component beyond the actuated closed position of the switch. The second stop simultaneously defines the maximum reset force at the switch component. A simple configuration results when the contact spring lies against the second stop in the actuated, closed position of the switch.

Advantageously, the pivot bearing is formed by a bearing shaft of the one component on which a bearing bushing of the other component is journalled. Bearing shaft and bearing bushing need not be strictly cylindrical components, instead, these components can have struts or the like. Advantageously, the bearing shaft is formed on the bearing component and the bearing bushing is formed on the switch component. The bearing bushing has a longitudinal slot which extends over at least a portion of the length of the bearing bushing. The longitudinal slot is advantageously configured to be so wide that the bearing bushing can be clipped onto the bearing shaft. In this way, a simple assembly results. A simple configuration of the first stop can be achieved without additional components if the first stop is formed by a nose on the bearing shaft which coacts with an edge on the longitudinal slot of the bearing bushing.

Advantageously, the switch component has an operator-controlled lever for actuating the switch. The switch component is advantageously configured as one piece with the operator-controlled lever and is made of plastic. The elasticity of the torsion section can be adjusted via the selection of a suitable plastic. A simple assembly is achieved with the one piece configuration of switch component and operator-controlled lever. In order to achieve a good introduction of force, the operator-controlled lever is arranged approximately at the elevation of the contact spring viewed in the direction of the pivot axis of the pivot bearing. In order to ensure that the switch is overpushed by the operator, a rise or elevation is arranged in the movement path of the contact spring between the open position and the closed unactuated position. To move the contact spring over the elevation, the actuating force first increases and reduces abruptly after the elevation is overcome. Since the operator continues to develop a force on the operator-controlled lever, the switch component is moved beyond the unactuated closed position. A simple assembly without additional components is achieved when the elevation is formed by a wall section of the switch component. Advantageously, in the open position of the switch, the contact spring lies behind the wall section. The wall section thereby defines simultaneously the open position of the switch.

Advantageously, the contact spring fixes at least one position of the switch, especially, the open position and the closed, unactuated position.

The switch is advantageously the ignition switch for an internal combustion engine in a portable handheld work apparatus.

The switch is advantageously connected to an ignition module via a line and to the engine via a ground line.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
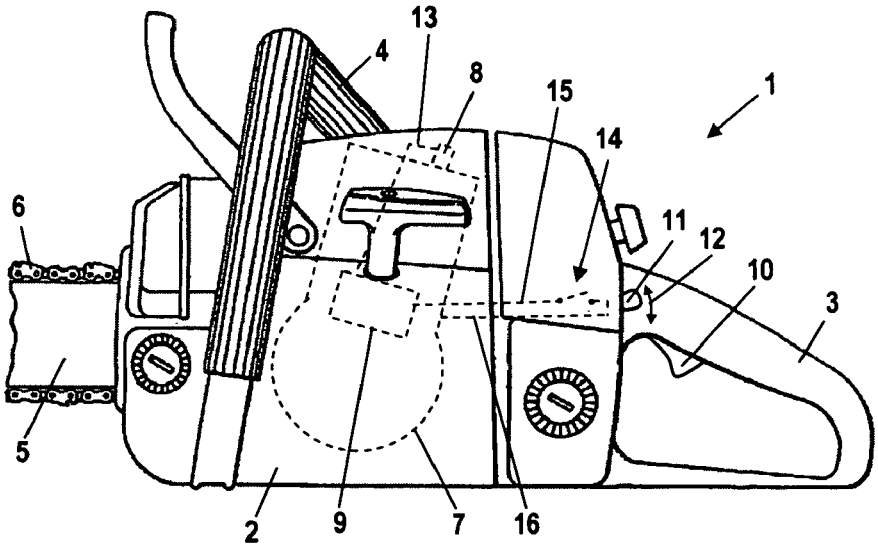
FIG. 1 shows a schematic of a portable handheld motor-driven chain saw.

In FIG. 1, a motor-driven chain saw 1 is schematically shown as an example for a portable handheld work apparatus. The switch arrangement of the invention can, however, also be utilized in other portable handheld work apparatus such as in cutoff machines, brushcutters or the like. Also, other areas of application besides portable handheld work apparatus can be advantageous.

The motor-driven chain saw 1 includes a housing 2 whereon a rear handle 3 and a tubular handle 4 are mounted. The motor-driven chain saw 1 includes a guide bar 5 which projects forwardly on the side of the housing facing away from the rearward handle 3. A saw chain 6 is arranged on the guide bar 5 to move around the periphery thereof. The saw chain 6 is driven by an internal combustion engine 7 which is schematically shown in FIG. 1 and is mounted in housing 2. The engine 7 is advantageously a single cylinder engine, especially a two-stroke engine. The engine 7 can, however, also be a four-stroke engine.

The internal combustion engine 7 includes a spark plug 8 which is connected to an ignition module 9 via an ignition line 13. The ignition module 9 is connected via a line 15 to a switch 14 which is configured as an ignition switch. In the closed state, the switch 14 connects the line 15 to a ground line 16 which is connected to the ground of the engine 7, for example, the metal crankcase or the metal cylinder of the engine 7. For closed switch 14, the ignition module 9 is thereby connected to the ground of the engine 7 and is therefore grounded. In this way, no ignition spark can occur at the spark plug 8.

For operating the switch 14, an operator-controlled lever 11 is provided which projects out from the housing 2 and can be pivoted in the direction of double arrow 12. A throttle lever 10 is provided at the rearward handle 3 for operating the engine 7.

Figure 2:
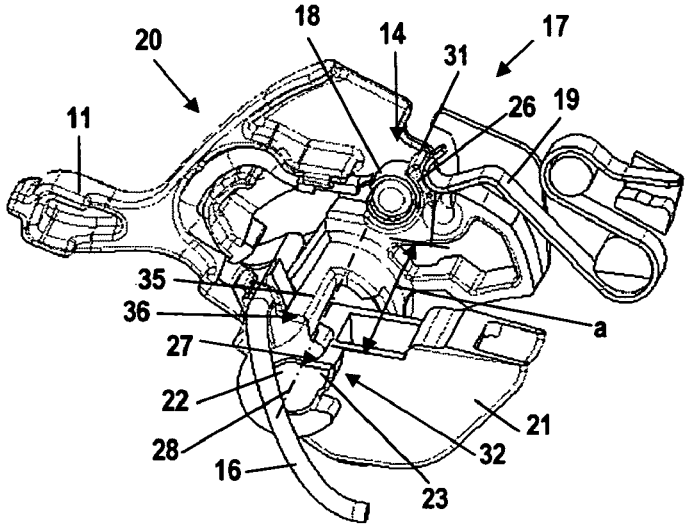
FIG. 2 is a perspective view of a switch arrangement of the motor-driven chain saw in the open position of the switch.
Figure 3:
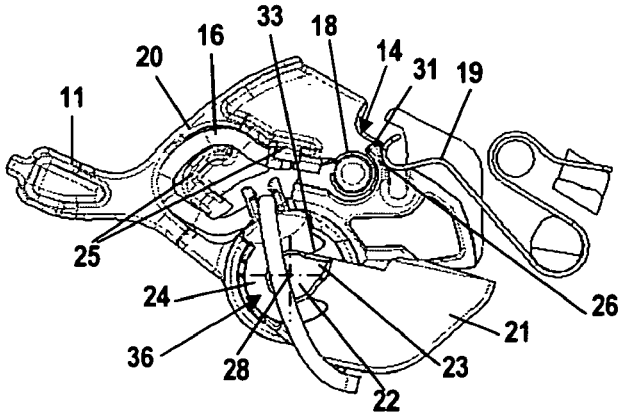
FIG. 3 is a side elevation view of the switch arrangement of FIG. 2.

FIGS. 2 and 3 show the switch 14 in the open position. In this position, the ignition module 9 is not grounded and the internal combustion engine 7 is operationally ready. The switch 14 includes a contact spring 19 and a contact 18 which are spaced from each other in the open position 17 of the switch 14. The contact spring 19 is advantageously connected to the ignition module 9 and the contact 18 is connected via the ground line 16 to the housing of the internal combustion engine 7.

The contact 18 is arranged on a switch component 20 which is configured as one piece with the operator-controlled lever 11 and is advantageously made of plastic. The ground line 16 is guided with several guides 25 on the switch component 20. These guides are configured as laterally projecting ribs on the switch component 20 and are configured as integral parts thereof. The guides 25 hold the ground line 16 in its position. The switch component 20 is pivotally journalled with a pivot bearing 36 on a bearing component 21. The bearing component 21 is advantageously arranged essentially fixed in location in the housing 2 of the motor-driven chain saw 1. The bearing component 21 can, for example, be configured as one piece with the housing of an air filter of the engine 7 which is fixedly connected to the housing 2 or is connected to the housing 2 via vibration damping elements.

The pivot bearing 36 is formed by a bearing shaft 22, which is configured as one piece with the bearing component 21, and a bearing bushing 24 pivotally journalled on the bearing shaft 22. The bearing bushing 24 is configured as one piece with the switch component 20 and advantageously is made of the same plastic as the switch component 20.

As shown in FIG. 2, the operator-controlled lever 11 is arranged approximately in a plane with the contact spring 19 and the cylindrically configured contact 18. The plane lies perpendicular to the pivot axis 28 of the pivot bearing 36. A first stop 27 is arranged at a distance (a) to the contact spring 19 and also to the contact 18 and to the operator-controlled lever 11. The distance (a) is measured in the direction of the pivot axis 28. The first stop 27 is formed by a nose 23 which is formed on the bearing shaft 22 and projects radially outwardly from the bearing shaft 22. The nose 23 projects into a longitudinal slot 32 of the bearing bushing 24 and coacts with an edge 33 on the longitudinal slot 32. The nose 23 lies at a distance to the edge 33 in the open position 17 of the switch 14 shown in FIGS. 2 and 3.

As especially shown in FIG. 2, the longitudinal slot 32 extends only over a portion of the length of the switch component 20. This length is measured in the direction of the pivot axis 28. The longitudinal slot 32 has a lesser width in the region of the first stop 27 than in the region between the first stop 27 and the plane of the operator-controlled lever 11. The longitudinal slot 32 is configured somewhat narrower than the diameter of the bearing shaft 22 so that the switch component 20 can be clipped onto the bearing component 21. In this way, a simple assembly results. The bearing shaft 22 and the bearing bushing 24 can include one or several bearing sections and need not be configured as a bearing over the entire length.

In the open position 17 of the switch 14 shown in FIGS. 2 and 3, the contact spring 19 lies against a wall section 26 of the switch component 20. The wall section 26 extends along the outer periphery of the contact 18 and separates the contact spring 19 from the contact 18. A rise or elevation 31 is formed on the wall section 26 and this elevation pivots the contact spring radially outwardly in clockwise direction about the pivot axis 28 when there is a movement of the switch component 20 in FIGS. 2 and 3. The elevation 31 is arranged in the movement path of the contact spring 19, that is, in the region whereat the contact spring 19 slides off when pivoting the switch component 20 between the different switch positions.

Figure 4:
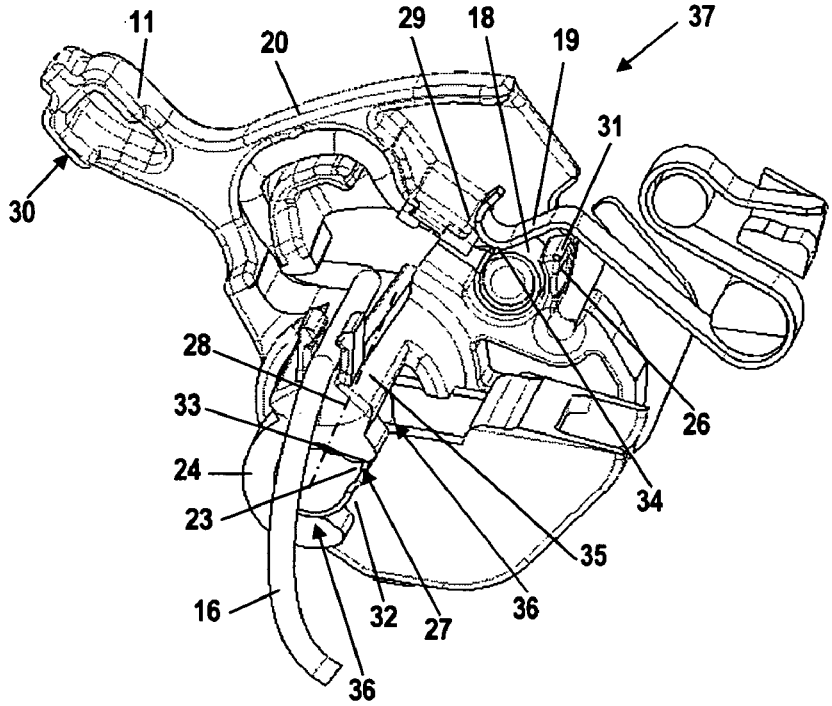
FIG. 4 is a perspective view of the switch arrangement of FIG. 2 shown in the actuated, closed position.
Figure 5:
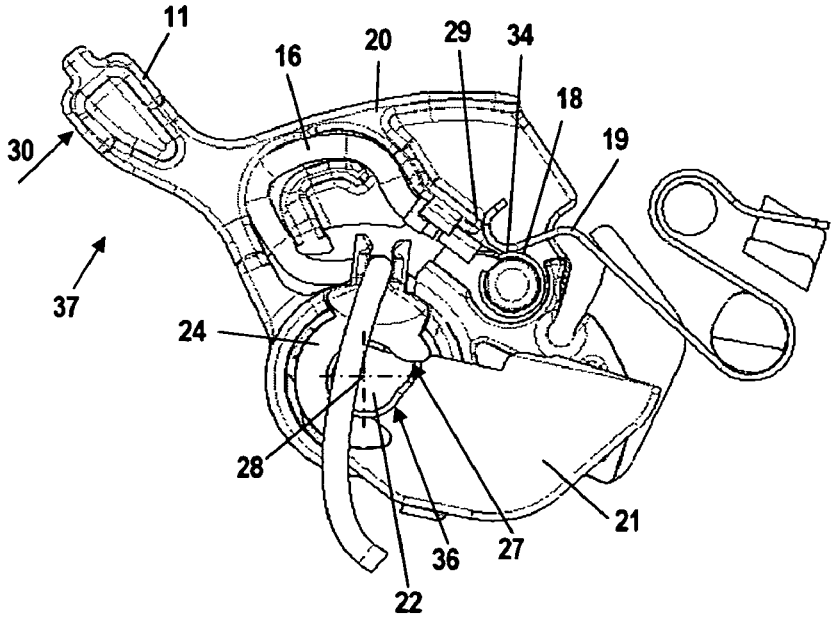
FIG. 5 is a side elevation view of the switch arrangement of FIG. 4.
Figure 6:
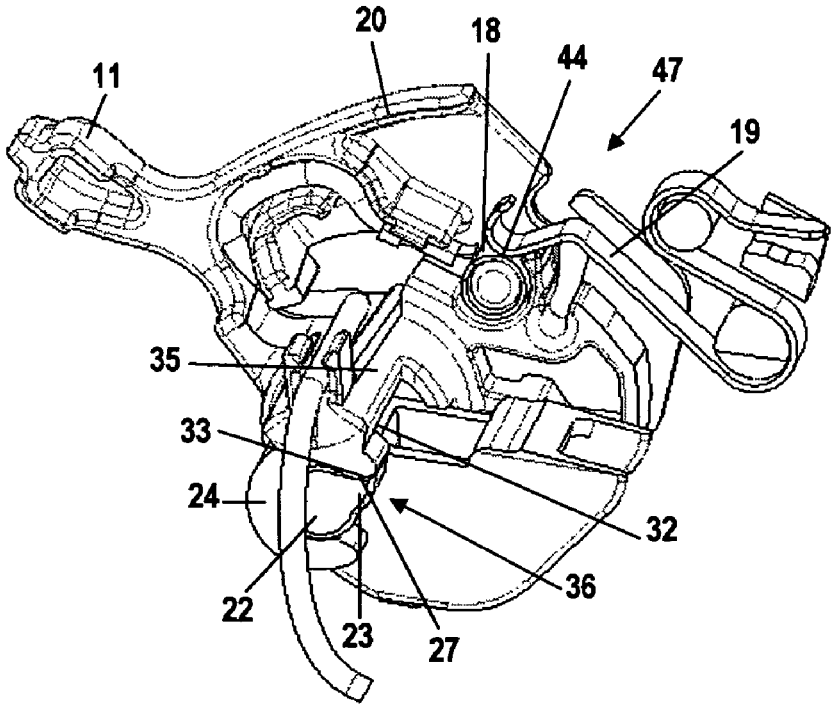
FIG. 6 is a perspective view of the switch arrangement in the unactuated, closed position; and, FIG. 7 is a side elevation view of the switch arrangement of FIG. 6.
Figure 7:
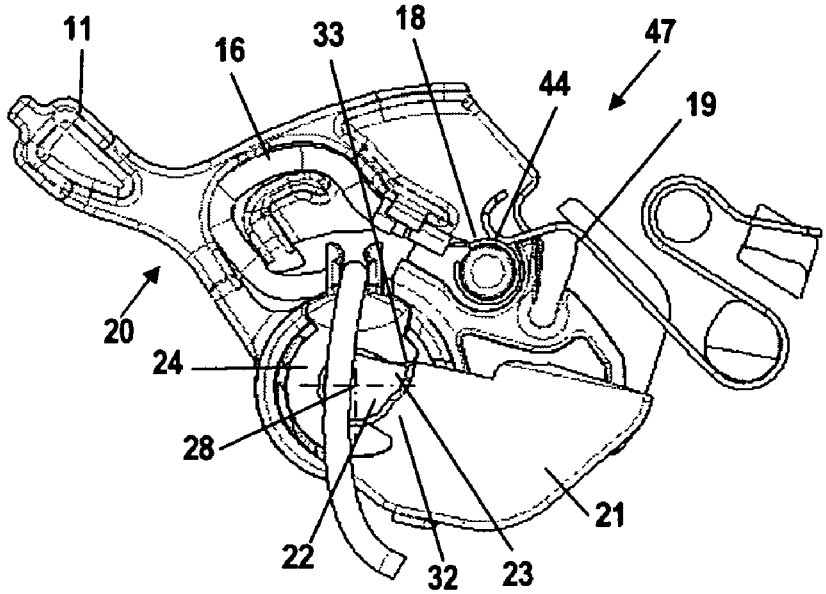

The contact spring 19 is deflected upwardly by the elevation 31 when there is a pivoting of the switch component 20 out of the open position 17, which is shown in FIGS. 2 and 3, into the actuated position 37 shown in FIGS. 4 and 5. Thereafter, the contact spring 19 springs back onto the contact 18. In order to overcome the elevation 31, the operator must press against the operator-controlled lever 11 in the direction of the arrow 30 shown in FIGS. 4 and 5 and apply an actuating force. The needed actuating force abruptly reduces after overcoming the elevation 31. In this way, the switch component 20 is pivoted until the contact spring 19 lies against the second stop 29 shown in FIGS. 4 and 5. The second stop 29 is likewise formed by a wall of the switch component 20. Until the contact spring 19 lies against the second stop 29, the contact spring 19 slides over the contact 18. In the actuated, closed position 37 of the switch 14 shown in FIGS. 4 and 5, the contact spring 19 lies against a contact location 34 on the contact 18. In the closed, actuated position 37 of the switch 14 shown in FIGS. 4 and 5, the nose 23 lies against the edge 33 of the first stop 27. The bearing bushing 24 forms a torsion section 35 in the region between the first stop 27 and the contact spring 19. In the actuated position of the switch 14 shown in FIGS. 4 and 5, this torsion section 35 is elastically deformed. The deformation takes place because of the actuating force 30 when displacing the switch component 20.

As soon as the operator releases the operator-controlled lever 11, the switch component 20 is returned opposite to the actuation direction, that is, in the counterclockwise direction of FIGS. 4 to 7. In this way, the contact spring 19 slides on the contact 18 until it lies on the contact 18 at a contact location 44. The return force is developed by the elastically deformed torsion section 35. In the unactuated, closed position 47 of the switch 14 shown in FIGS. 6 and 7, the torsion section 35 is not deformed. The projection 23 of the first stop 27 lies against the edge 33. In this way, the first stop 27 defines the contact location 44 whereat the contact spring 19 lies against the contact 18.

A self cleaning effect of the switch 14 can be obtained in a simple manner with the configuration of a section of the pivot bearing 36, especially of a section of the bearing bushing 24, as a torsion section 35. The switch 14 is advantageously overpushed with each actuation thereof until it is in the actuated closed position 37. During this operation, the torsion section 35 is deformed. When the operator releases the switch component 20, the torsion section 35 effects a reset of the switch component 20. The contact spring 19 slides between the contact locations 34 and 44 on the contact 18 and cleans the same thereby.

Alternatively or in addition, a section of the bearing shaft 22 can be configured as a torsion section. This can be achieved by a corresponding geometric configuration of the bearing shaft 22 in order to permit an elastic deformation of the bearing shaft 22. It can also be provided to form the bearing shaft as one piece with the switch component 20 and the bearing bushing as one piece with the bearing component 21. Other configurations of the pivot bearing 36 can also be advantageous.

It is understood that the foregoing description is that of the preferred embodiments of the invention and that various changes and modifications may be made thereto without departing from the spirit and scope of the invention as defined in the appended claims.

What is claimed is:

1. A switch arrangement comprising:

a switch component;

a bearing component;

a switch including a contact and a contact spring lying in contact engagement with said contact in an unactuated closed position of said switch;

a pivot bearing for pivotally journalling said switch component on said bearing component to permit a movement of said switch from an open position to said unactuated closed position and to an actuated closed position;

said pivot bearing including a torsion section which permits an overpushing of said switch beyond said unactuated closed position into said actuated closed position; and, said contact spring sliding on said contact between said unactuated closed position and said actuated closed position.

2. The switch arrangement of claim 1, wherein said pivot bearing defines a pivot axis; said bearing component and said switch component conjointly forming a first stop for the pivot movement of said switch component whereat said bearing component and said switch component lie one against the other in said unactuated closed position; and, said first stop is at a distance (a) to said contact spring measured in the direction of said pivot axis.

3. The switch arrangement of claim 2, wherein said torsion section is arranged in the effective work direction between said first stop and said contact spring.

4. The switch arrangement of claim 2, further comprising a second stop for preventing a movement of said switch component beyond said actuated closed position of said switch.

5. The switch arrangement of claim 4, wherein said contact spring lies against said second stop in said actuated closed position of said switch.

6. The switch arrangement of claim 1, wherein said pivot bearing comprises a bearing shaft formed on one of said components and a bearing bushing formed on the other one of said components and journalled on said bearing shaft.

7. The switch arrangement of claim 6, wherein said one component is said bearing component and said other component is said switch component.

8. The switch arrangement of claim 6, wherein said bearing bushing has a longitudinal slot extending over at least a portion of the length of said bearing bushing.

9. The switch arrangement of claim 8, wherein said bearing bushing has an edge at said longitudinal slot; and, a stop is formed by a nose on said bearing shaft which coacts with said edge on said longitudinal slot.

10. The switch arrangement of claim 1, wherein said switch component has an operator-controlled lever for actuating said switch.

11. The switch arrangement of claim 10, wherein said switch component and said operator-controlled lever are configured as a single element made of plastic.

12. The switch arrangement of claim 10, wherein said pivot bearing defines a pivot axis; and, said operator-controlled lever is arranged approximately at the elevation of said contact spring when viewed in the direction of said pivot axis.

13. The switch arrangement of claim 1, wherein said contact spring moves over a movement path between said open position and said unactuated closed position; and, said switch arrangement further comprises a rise in said movement path between said open position and said unactuated closed position.

14. The switch arrangement of claim 13, wherein said rise is formed as a wall section of said switch component.

15. The switch arrangement of claim 14, wherein said contact spring lies behind said rise when said switch is in said open position.

16. The switch arrangement of claim 1, wherein said contact spring determines at least one of said positions of said switch.

17. The switch arrangement of claim 16, wherein said contact spring determines said open position and said unactuated closed position.

18. The switch arrangement of claim 1, wherein said switch is an ignition switch for an internal combustion engine in a portable handheld work apparatus.

19. The switch arrangement of claim 18, wherein said switch is connected via a line to an ignition module and via a ground line to said internal combustion engine.

* * * * *